US012503800B2

(12) United States Patent
Sekino et al.

(10) Patent No.: US 12,503,800 B2
(45) Date of Patent: Dec. 23, 2025

(54) FABRIC PROCESSING DEVICE

(71) Applicant: SEIKO EPSON CORPORATION, Tokyo (JP)

(72) Inventors: Hirokazu Sekino, Chino (JP); Osamu Katsuda, Matsumoto (JP)

(73) Assignee: SEIKO EPSON CORPORATION (JP)

( * ) Notice: Subject to any disclaimer, the term of this patent is extended or adjusted under 35 U.S.C. 154(b) by 209 days.

(21) Appl. No.: 18/324,189

(22) Filed: May 26, 2023

(65) Prior Publication Data

US 2023/0383451 A1 Nov. 30, 2023

(30) Foreign Application Priority Data

May 27, 2022 (JP) ..... 2022-086863

(51) Int. Cl.
*D06B 23/04* (2006.01)
*D06B 1/02* (2006.01)
*D06B 23/20* (2006.01)

(52) U.S. Cl.
CPC ..... *D06B 23/04* (2013.01); *D06B 1/02* (2013.01); *D06B 23/20* (2013.01)

(58) Field of Classification Search
CPC ..... D06B 1/02; D06B 1/08; D06B 5/08
See application file for complete search history.

(56) References Cited

U.S. PATENT DOCUMENTS 3,553,006 A * 1/1971 Beau et al. ..... D06B 1/08 118/410
3,654,654 A * 4/1972 Abreu ..... G03G 17/04 118/259
4,141,315 A * 2/1979 Nassenstein ..... D06B 1/08 118/420
4,231,129 A * 11/1980 Winch ..... D06B 5/08 8/149.1
4,497,095 A 2/1985 Minemura et al.
4,790,155 A * 12/1988 Daniel ..... D06B 1/02 118/678
2001/0018786 A1 9/2001 Greenway et al.
2007/0271968 A1* 11/2007 Hartmann ..... D06B 1/08 68/200
2011/0220147 A1* 9/2011 Schreiber ..... B08B 1/34 134/95.2

(Continued)

FOREIGN PATENT DOCUMENTS

JP S57-061758 A 4/1982
JP S63-309664 A 12/1988

(Continued)

*Primary Examiner* — Jillian K Pierorazio
(74) *Attorney, Agent, or Firm* — Harness, Dickey & Pierce, P.L.C.

(57) ABSTRACT

A fabric processing device includes a transport unit configured to transport a fabric in a transport direction; a support unit configured to support the fabric; a liquid ejecting unit configured to eject a liquid onto the fabric supported by the support unit; and an adjusting unit configured to adjust the liquid ejected as a continuous flow from the liquid ejecting unit to collide with the fabric in a state of being liquid droplets. The fabric processing device having such a configuration can effectively improve texture of the fabric.

13 Claims, 14 Drawing Sheets

(56) References Cited

U.S. PATENT DOCUMENTS

| | | | | |
|---|---|---|---|---|
| 2014/0238295 | A1* | 8/2014 | Valle | D06B 1/02 68/5 D |
| 2014/0242210 | A1* | 8/2014 | Mellin | D21F 3/10 68/5 D |
| 2021/0262134 | A1* | 8/2021 | Tsai | D04H 1/4291 |
| 2022/0032627 | A1* | 2/2022 | Okada | B41J 2/19 |
| 2022/0134303 | A1* | 5/2022 | Hussey | H05H 1/2418 118/723 R |
| 2022/0178063 | A1* | 6/2022 | Kew | D06B 1/08 |
| 2022/0307182 | A1* | 9/2022 | Chang | D06P 1/0016 |
| 2024/0167206 | A1* | 5/2024 | Suzuki | D06G 1/005 |

FOREIGN PATENT DOCUMENTS

| | | | |
|---|---|---|---|
| JP | H05-239761 | A | 9/1993 |
| JP | H07-133578 | A | 5/1995 |
| JP | 2007-046209 | A | 2/2007 |
| JP | 2009-240989 | A | 10/2009 |
| JP | 2012-510005 | A | 4/2012 |
| JP | 2013-056522 | A | 3/2013 |

* cited by examiner

FABRIC PROCESSING DEVICE

The present application is based on, and claims priority from JP Application Serial Number 2022-086863, filed May 27, 2022, the disclosure of which is hereby incorporated by reference herein in its entirety.

BACKGROUND

1. Technical Field

The present disclosure relates to a fabric processing device.

2. Related Art

In the related art, various types of processing have been performed on a fabric in order to improve texture of the fabric. For example, JPH07-133578A discloses an air flow type texture processing method for adjusting texture such as flexibility by using an air flow on a fabric and the like subjected to textile printing processing. In the air flow type texture processing method disclosed in JPH07-133578A, water or steam is sprayed and supplied into an air flow, the air flow is ejected from a processed fluid ejecting unit onto a fabric to impart a wetting effect to the fabric, and then a dry air flow is applied to the fabric to dry the fabric. In the air flow type texture processing method disclosed in JPH07-133578A, an impact is repeatedly applied by the air flow, and thus fine fluff (peaching processing), a drape property, and a slimy feeling are exhibited on a surface of the fabric.

However, in the method for improving the texture of the fabric by applying the air flow to the fabric as described in JPH07-133578A, it is difficult to apply a strong impact to the fabric. Therefore, it is difficult to sufficiently improve the texture of the fabric, and it takes a long time to sufficiently improve the texture of the fabric. As described above, in a method in the related art for improving texture of a fabric, it is difficult to effectively improve the texture of the fabric.

SUMMARY

A fabric processing device according to the present disclosure for solving the above problems includes: a transport unit configured to transport a fabric in a transport direction; a support unit configured to support the fabric; a liquid ejecting unit configured to eject a liquid onto the fabric supported by the support unit; and an adjusting unit configured to adjust the liquid ejected as a continuous flow from the liquid ejecting unit to collide with the fabric in a state of being liquid droplets.

DESCRIPTION OF EXEMPLARY EMBODIMENTS

Figure 1:
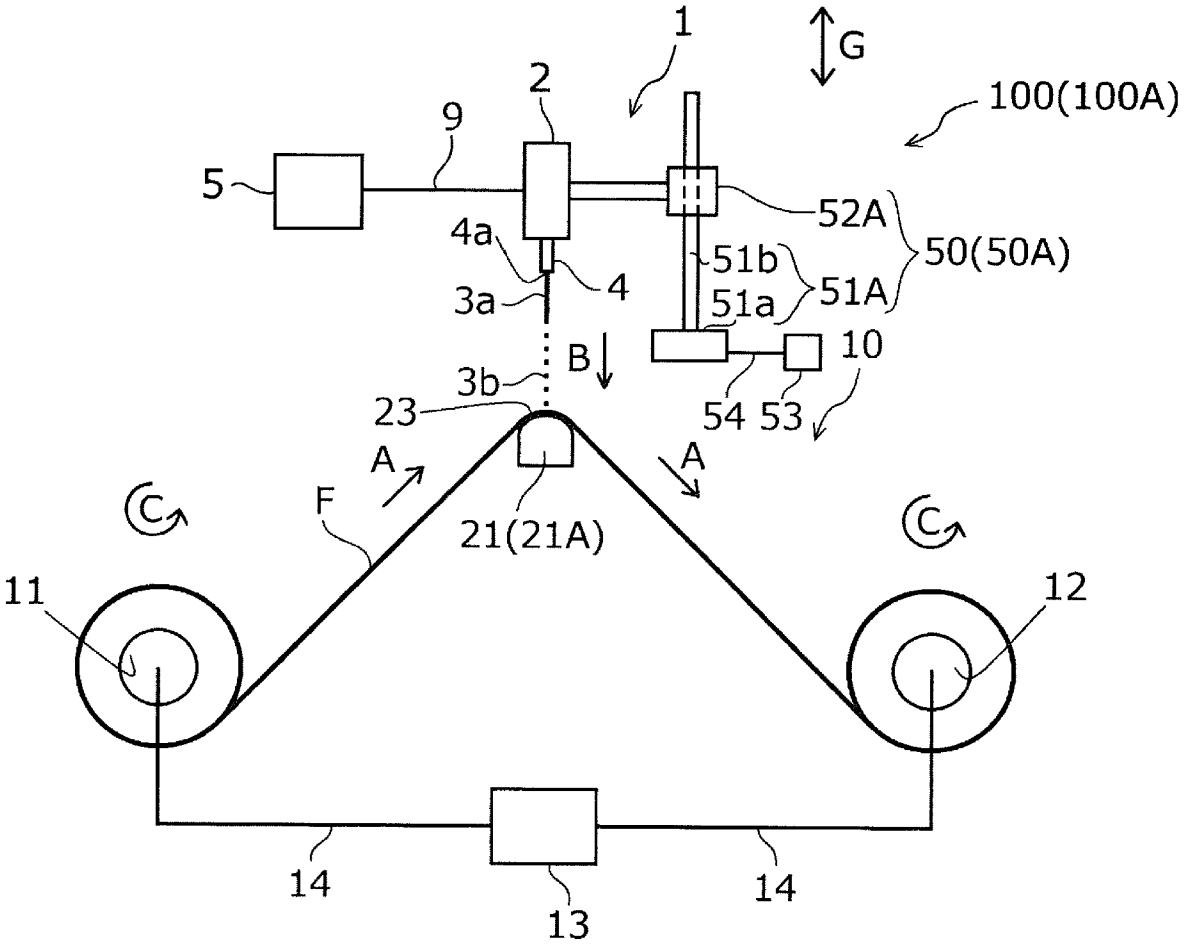
FIG. 1 is a schematic diagram showing a fabric processing device according to a first embodiment.

First, the present disclosure will be schematically described.

A fabric processing device according to a first aspect of the present disclosure includes: a transport unit configured to transport a fabric in a transport direction; a support unit configured to support the fabric; a liquid ejecting unit configured to eject a liquid onto the fabric supported by the support unit; and an adjusting unit configured to adjust the liquid ejected as a continuous flow from the liquid ejecting unit to collide with the fabric in a state of being liquid droplets.

According to this aspect, the liquid ejected as the continuous flow from the liquid ejecting unit is adjusted to collide with the fabric in the state of being the liquid droplets. Therefore, the processing of the fabric is performed by a method capable of applying, to the fabric, a strong impact by which the liquid ejected as the continuous flow collides with the fabric in the state of being the liquid droplets. Therefore, texture of the fabric can be effectively improved.

The fabric processing device according to a second aspect of the present disclosure is directed to the first aspect, in which the adjusting unit is an interval adjusting unit configured to adjust an interval between the liquid ejecting unit and the fabric such that the liquid collides with the fabric in the state of being the liquid droplets.

According to this aspect, the interval between the liquid ejecting unit and the fabric is adjusted such that the liquid collides with the fabric in the state of being the liquid droplets. Therefore, it is possible to cause the liquid ejected as the continuous flow from the liquid ejecting unit to collide with the fabric in the state of being the liquid droplets without complicating the configuration of the liquid ejecting unit.

The fabric processing device according to a third aspect of the present disclosure is directed to the second aspect, and the fabric processing device further includes: a holding unit configured to hold the liquid ejecting unit, in which the interval adjusting unit is coupled to the holding unit.

According to this aspect, the fabric processing device includes the holding unit which holds the liquid ejecting unit and to which the interval adjusting unit is coupled. Therefore, for example, when it is desired to move the liquid ejecting unit, the liquid ejecting unit can be easily moved by moving the holding unit.

The fabric processing device according to a fourth aspect of the present disclosure is directed to the third aspect, in which the interval adjusting unit includes a fixed unit and a movable unit whose position in an interval direction between the liquid ejecting unit and the fabric can be changed with respect to the fixed unit, and the holding unit is coupled to the movable unit.

According to this aspect, the interval adjusting unit includes the fixed unit and the movable unit, and the holding unit is coupled to the movable unit. With such a configuration, the liquid ejecting unit can be easily moved with respect to the fabric.

The fabric processing device according to a fifth aspect of the present disclosure is directed to the third aspect, and the fabric processing device further includes: a moving mechanism configured to reciprocate the holding unit in a direction intersecting the transport direction.

According to this aspect, the fabric processing device includes the moving mechanism configured to reciprocate the holding unit in the direction intersecting the transport direction. With such a configuration, it is possible to eject the liquid over the entire fabric in a width direction using the small liquid ejecting unit and the holding unit.

The fabric processing device according to a sixth aspect of the present disclosure is directed to the first aspect, in which the adjusting unit is a liquid droplet forming distance adjusting unit configured to adjust a liquid droplet forming distance, which is a distance from the liquid ejecting unit until the liquid ejected as the continuous flow becomes the liquid droplets, such that the liquid collides with the fabric in the state of being the liquid droplets.

According to this aspect, by adjusting the liquid droplet forming distance, the liquid collides with the fabric in the state of being the liquid droplets. Therefore, it is possible to cause the liquid ejected as the continuous flow from the liquid ejecting unit to collide with the fabric in the state of being the liquid droplets without changing the interval between the liquid ejecting unit and the fabric.

The fabric processing device according to a seventh aspect of the present disclosure is directed to any one of the first to sixth aspects, in which the liquid ejecting unit is configured to eject the liquid in the continuous flow at an ejecting speed of 30 m/s or more.

According to this aspect, the liquid is ejected in the continuous flow at the ejecting speed of 30 m/s or more. That is, a strong impact can be applied to the fabric by causing the liquid to collide with the fabric at the high ejecting speed of 30 m/s or more. Therefore, the texture of the fabric can be particularly effectively improved.

The fabric processing device according to an eighth aspect of the present disclosure is directed to the seventh aspect, in which, the liquid ejecting unit is configured to eject the liquid in the continuous flow at an ejecting speed of 500 m/s or less.

According to this aspect, the liquid is ejected in the continuous flow at the ejecting speed of 500 m/s or less. When the ejecting speed exceeds 500 m/s, the fabric may be damaged, but the texture of the fabric can be effectively improved without damaging the fabric.

The fabric processing device according to a ninth aspect of the present disclosure is directed to any one of the first to sixth aspects, in which the support unit has a support surface that supports the fabric, and the liquid ejecting unit is disposed at a position facing the support surface.

According to this aspect, the support unit has the support surface that supports the fabric, and the liquid ejecting unit is disposed at the position facing the support surface. Therefore, a configuration capable of effectively improving the texture of the fabric can be easily formed.

The fabric processing device according to a tenth aspect of the present disclosure is directed to the ninth aspect, in which the support surface is a convex curved surface protruding toward a liquid ejecting unit side.

According to this aspect, the support surface is the convex curved surface protruding toward the liquid ejecting unit side. With such a configuration, the fabric can be firmly supported by applying tension to the convex curved surface, and the liquid can be suitably ejected onto the fabric.

The fabric processing device according to an eleventh aspect of the present disclosure is directed to the ninth aspect, in which the support surface is a flat surface.

According to this aspect, the support surface is the flat surface. With such a configuration, a wide range of the fabric can be supported by the support surface, and the liquid can be suitably ejected over the wide range of the fabric.

The fabric processing device according to a twelfth aspect of the present disclosure is directed to the eleventh aspect, in which the support surface has a normal line of the flat surface forming an angle of 0° or more and 45° or less with respect to a horizontal plane.

According to this aspect, the support surface has the normal line of the flat surface forming the angle of 0° or more and 45° or less with respect to the horizontal plane. With such a configuration, it is possible to prevent the liquid ejected from the liquid ejecting unit from dripping onto the liquid ejecting unit, and it is also possible to prevent the liquid rebounding from the support surface from adhering to the liquid ejecting unit, and thus it is possible to prevent the occurrence of ejecting failure in the liquid ejecting unit.

The fabric processing device according to a thirteenth aspect of the present disclosure is directed to any one of the first to sixth aspects, in which the liquid ejecting unit includes a nozzle having at least one ejecting port configured to eject the liquid, a liquid transport unit configured to transport the liquid to the ejecting port, and a pressurizing unit configured to pressurize the liquid in the liquid transport unit.

According to this aspect, the liquid ejecting unit includes the nozzle having at least one ejecting port configured to eject the liquid, the liquid transport unit configured to transport the liquid to the ejecting port, and the pressurizing unit configured to pressurize the liquid in the liquid transport unit. With such a configuration, it is possible to suitably form the liquid ejecting unit which ejects the liquid as the continuous flow, and in which the liquid ejected as the continuous flow collides with the fabric in the state of being the liquid droplets.

The fabric processing device according to a fourteenth aspect of the present disclosure is directed to any one of the first to sixth aspects, and the fabric processing device further includes: a control unit configured to control an ejecting amount of the liquid ejected from the liquid ejecting unit.

According to this aspect, the fabric processing device includes the control unit configured to control the ejecting amount of the liquid ejected from the liquid ejecting unit. Therefore, the liquid can be automatically ejected from the liquid ejecting unit in a preferable ejecting amount.

The fabric processing device according to a fifteenth aspect of the present disclosure is directed to any one of the first to sixth aspects, in which the transport unit includes a driving roller configured to transport the fabric in the transport direction by rotating.

According to this aspect, the transport unit includes the driving roller configured to transport the fabric in the transport direction by rotating. With such a configuration, it is possible to suitably form the transport unit that transports the fabric in the transport direction.

The fabric processing device according to a sixteenth aspect of the present disclosure is directed to the thirteenth aspect, in which a plurality of the ejecting ports are provided over the entire liquid ejecting unit in a direction intersecting the transport direction of the fabric, and the liquid ejecting unit is configured to be movable in the direction intersecting the transport direction during transport of the fabric.

According to this aspect, the plurality of ejecting ports are provided over the entire liquid ejecting unit in the direction intersecting the transport direction of the fabric, and the liquid ejecting unit is configured to be movable in the direction intersecting the transport direction during transport of the fabric. Therefore, it is possible to eject the liquid particularly densely to the fabric.

First Embodiment

Hereinafter, an embodiment of the present disclosure will be described with reference to accompanying drawings. First, an outline of a fabric processing device 100A according to a first embodiment of the present disclosure as a fabric processing device 100 will be described with reference to FIG. 1. The fabric processing device 100A shown in FIG. 1 includes a transport unit 10 that transports a fabric F in a transport direction A, a support unit 21 that supports the fabric F, and a liquid ejecting unit 1 that ejects a liquid 3 onto the fabric F supported by the support unit 21.

The transport unit 10 includes a setting shaft 11 on which the rolled fabric F can be set, and a winding shaft 12 on which the fabric F transported in the transport direction A can be wound in a roll shape. The setting shaft 11 and the winding shaft 12 are coupled to a transport control unit 13 via a cable 14, and are rotatable in a rotation direction C under the control of the transport control unit 13. The transport control unit 13 can apply desired tension to the fabric F transported in the transport direction A from the setting shaft 11 toward the winding shaft 12 by controlling a rotation speed of the winding shaft 12 to be faster than a rotation speed of the setting shaft 11 when the fabric F is transported.

From another point of view, the transport unit 10 of the fabric processing device 100A according to the embodiment includes the setting shaft 11 and the winding shaft 12 as a driving roller that transports the fabric F in the transport direction A by rotating. With such a configuration, it is possible to suitably form the transport unit 10 that transports the fabric F in the transport direction A.

A support unit 21A of the embodiment serving as the support unit 21 has a support surface 23 that supports the fabric F, and the support surface 23 is a convex curved surface that protrudes toward a liquid ejecting unit 1 side. With such a configuration, the fabric F can be firmly supported without a gap by applying tension to the convex curved surface, and the liquid 3 can be suitably ejected onto the fabric F. "The support surface 23 is a convex curved surface that protrudes toward the liquid ejecting unit 1 side" means, in detail, "a contact point between the support surface 23 and a straight line of the support surface 23 extending from the liquid ejecting unit 1 in an ejecting direction B and a peripheral region thereof form a convex curved surface that protrudes toward the liquid ejecting unit 1 side". Accordingly, a portion other than the contact point and the peripheral region thereof may not be a convex curved surface.

Here, the support unit 21A of the embodiment is made of stainless steel. When the support unit 21 is made of a hard material that is resistant to rust, such as stainless steel, corrosion or deformation caused by the liquid 3 ejected from the liquid ejecting unit 1 is prevented. By preventing corrosion and deformation of the support unit 21, it is possible to prevent damping of an impact pressure when the liquid 3 ejected from the liquid ejecting unit 1 lands on the fabric F, and it is possible to efficiently apply an impact for improving the texture to the fabric F.

The liquid ejecting unit 1 is disposed at a position facing the support surface 23. Therefore, a configuration capable of effectively improving the texture of the fabric F is easily formed. With such a configuration, the liquid 3 can be ejected from the liquid ejecting unit 1 substantially perpendicularly to the support surface 23. By ejecting the liquid 3 from the liquid ejecting unit 1 perpendicularly to the support surface 23, it is possible to efficiently apply an impact for improving the texture to the fabric F. In the embodiment, the liquid 3 is ejected from the liquid ejecting unit 1 substantially perpendicularly to the support surface 23, and the present disclosure is not limited to such a configuration. However, it is preferable that the liquid 3 is ejected from the liquid ejecting unit 1 at an angle of 0° or more and 45° or less with respect to a normal line of the support surface 23.

In the fabric processing device 100A according to the embodiment, the liquid ejecting unit 1 ejects the liquid 3 as a continuous flow 3*a* from an ejecting port 4*a* of a nozzle 4 toward the fabric F, and the liquid 3 ejected as the continuous flow 3*a* from the liquid ejecting unit 1 collides with the fabric F in a state of being liquid droplets 3*b*. In other words, in order to cause the liquid 3 ejected as the continuous flow 3*a* from the liquid ejecting unit 1 to collide with the fabric F in the state of being the liquid droplets 3*b*, an adjusting unit 50 that adjusts a position of the nozzle 4 is provided in order to set an interval from the ejecting port 4*a* to the fabric F to a desired interval equal to or larger than a liquid droplet forming distance that is a distance until the continuous flow 3*a* is formed into the liquid droplets 3*b*. Therefore, the fabric processing device 100A according to the embodiment can process the fabric F by a method capable of applying, to the fabric F, a strong impact by which the liquid 3 ejected as the continuous flow 3*a* collides with the fabric F in the state of being the liquid droplets 3*b*. Therefore, the fabric processing device 100A according to the embodiment can effectively improve the texture of the fabric F.

Here, an adjusting unit 50A according to the embodiment, which is the adjusting unit 50 that performs adjustment such that the liquid 3 ejected as the continuous flow 3*a* from the liquid ejecting unit 1 collides with the fabric F in the state of being the liquid droplets 3*b*, is an interval adjusting unit that performs adjustment such that the liquid 3 collides with the fabric F in the state of being the liquid droplets 3*b* by relatively adjusting a distance in an interval direction G that is an interval between the liquid ejecting unit 1 and the fabric F. As a method for adjusting the distance such that the liquid 3 collides with the fabric F in the state of being the liquid droplets 3*b*, there are a method for adjusting the interval between the liquid ejecting unit 1 and the fabric F and a method for adjusting the distance until the liquid 3 is formed into liquid droplets. Among these, by adopting a configuration in which the interval between the liquid ejecting unit 1 and the fabric F is adjusted as in the adjusting unit 50A according to the embodiment, it is possible to cause the liquid 3 ejected as the continuous flow 3*a* from the liquid ejecting unit 1 to collide with the fabric F in the state of being the liquid droplets 3*b* without complicating the configuration of the liquid ejecting unit 1. Strictly speaking, "the interval between the liquid ejecting unit 1 and the fabric F is adjusted" means "the interval in the ejecting direction B between the fabric F and the ejecting port 4*a* provided in the liquid ejecting unit 1 is adjusted".

As shown in FIG. 1, the fabric processing device 100A according to the embodiment includes a holding unit 2 which holds the nozzle 4 constituting the liquid ejecting unit 1. The adjusting unit 50A serving as the interval adjusting unit is coupled to the holding unit 2. Therefore, for example, when the nozzle 4 of the liquid ejecting unit 1 is desired to be moved, the fabric processing device 100A according to the embodiment can easily move the nozzle 4 by moving the holding unit 2.

As shown in FIG. 1, the adjusting unit 50A according to the embodiment includes a fixed unit 51A and a movable unit 52A whose position in the interval direction G can be changed with respect to the fixed unit 51A. The holding unit 2 is coupled to the movable unit 52A. With such a configuration, the liquid ejecting unit 1 can be easily moved with respect to the fabric F.

The fabric processing device 100A according to the embodiment includes an interval control unit 53, and the fixed unit 51A according to the embodiment includes a base portion 51*a* and a shaft portion 51*b* extending along the interval direction G. The fixed unit 51A is coupled to the interval control unit 53 by a cable 54, and the movable unit 52A is movable relative to the base portion 51*a* in the interval direction G along the shaft portion 51*b* under the control of the interval control unit 53.

Figure 2:
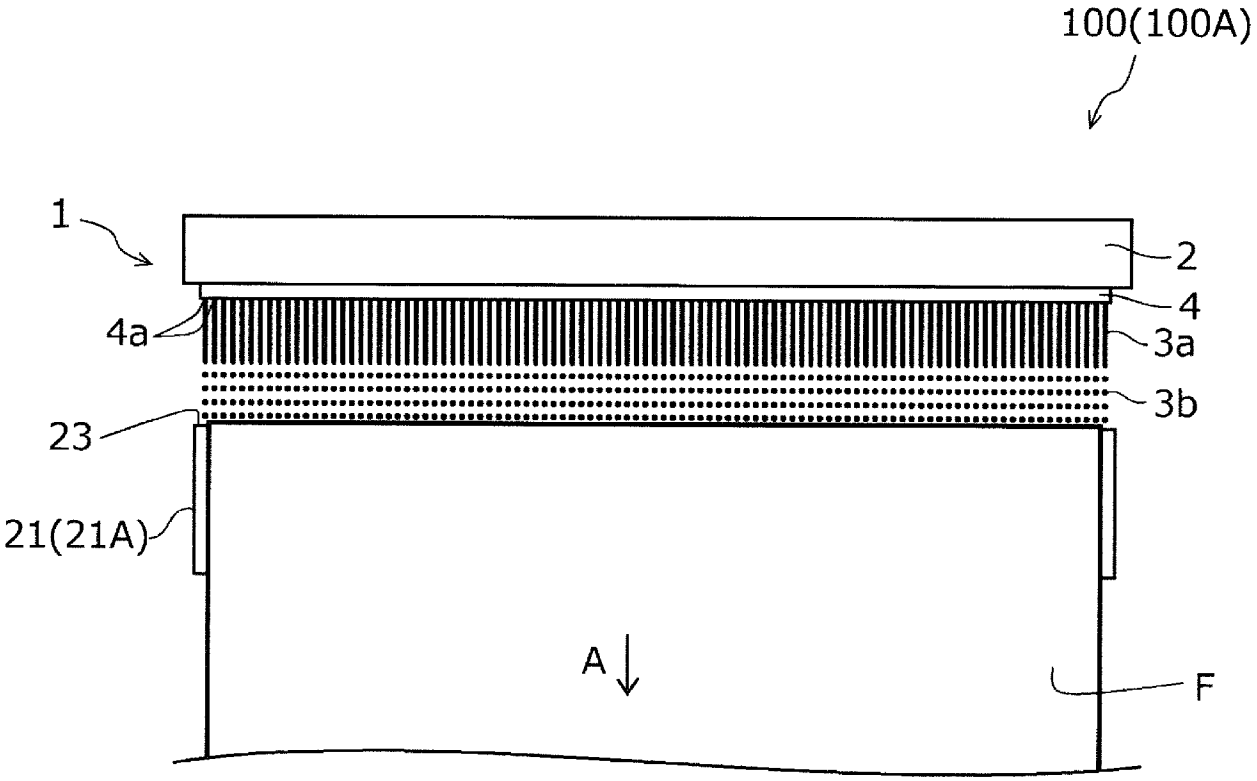
FIG. 2 is a schematic diagram showing a part of the fabric processing device in FIG. 1.

Next, the configuration of the liquid ejecting unit 1 will be further described in detail with reference to FIGS. 2 and 3. As shown in FIG. 2, the liquid ejecting unit 1 according to the embodiment includes the nozzle 4 in which a plurality of the ejecting ports 4*a* of the liquid 3 are provided in a line shape over the entire width direction that is a direction intersecting the transport direction A of the fabric F. The nozzle 4 is provided at a front end of the holding unit 2. In the nozzle 4, a reinforcement plate (not shown) having a hole portion having a diameter sufficiently larger than that of the ejecting port 4*a* is formed corresponding to a position of the ejecting port 4*a* over the entire width direction, thereby preventing deformation of the nozzle 4. However, the configuration of the holding unit 2 is not particularly limited, and instead of a line head as in the embodiment, for example, the holding unit 2 may be provided as a carriage capable of reciprocating in the width direction, and the liquid 3 may be ejected to the entire width direction of the fabric F by reciprocating the holding unit 2 in the width direction.

Figure 3:
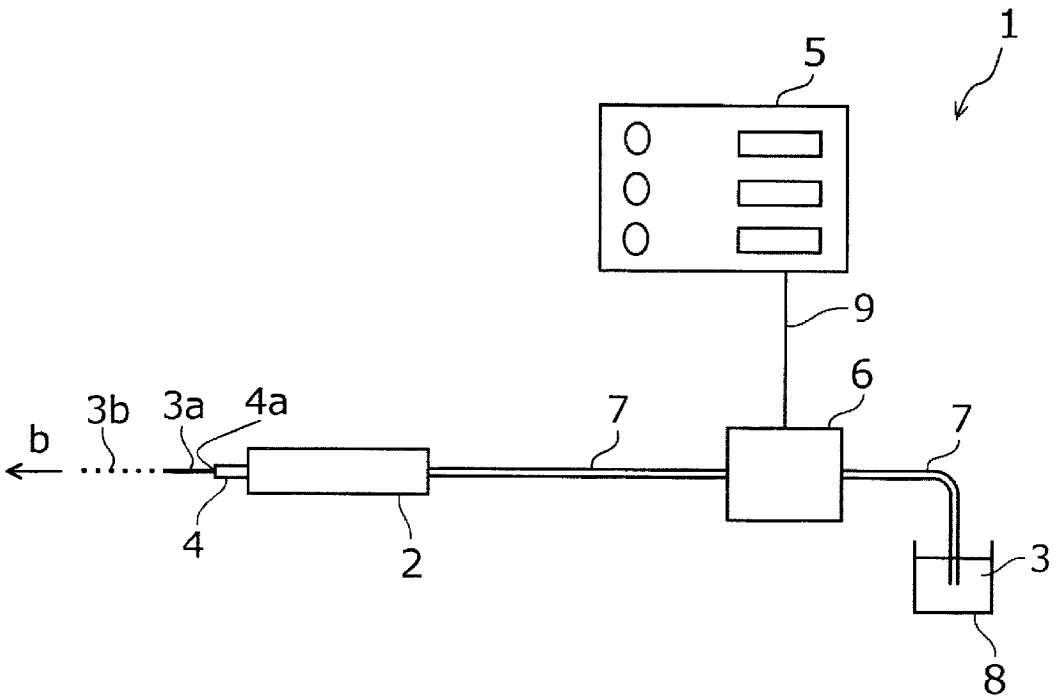
FIG. 3 is a schematic diagram showing a liquid ejecting unit of the fabric processing device in FIG. 1.

As shown in FIG. 3, the liquid ejecting unit 1 according to the embodiment includes a liquid transport unit 7 which is a tube for transporting the liquid 3 to the ejecting ports 4*a*, and a pressurizing unit 6 for pressurizing the liquid 3 in the liquid transport unit 7, in addition to the holding unit 2 in which the nozzle 4 having at least one ejecting port 4*a* for ejecting the liquid 3 is provided. With such a configuration, it is possible to suitably form the liquid ejecting unit 1 which ejects the liquid 3 as the continuous flow 3*a*, and in which the liquid 3 ejected as the continuous flow 3*a* collides with the fabric F in the state of being the liquid droplets 3*b*.

As described above, the liquid ejecting unit 1 according to the embodiment is a liquid ejecting device that causes the liquid droplets 3*b* to collide with the fabric F as an object in a state where the continuous flow 3*a* of the liquid 3 ejected continuously in the ejecting direction B from the plurality of ejecting ports 4*a* provided in the holding unit 2 is formed into the liquid droplets 3*b*. As the liquid 3, water can be preferably used, and a water solution containing water as a solvent and various solvents and additives, a volatile organic solvent, and the like can be used without particular limitation.

Here, the liquid transport unit 7 as a liquid sending flow path coupling a liquid storage unit 8 to the holding unit 2 is formed by using a soft resin material and the like, and thus it is possible to improve handling properties. The pressurizing unit 6 is driven under control of a control unit 5 coupled by a control signal line 9, and sends the liquid 3 at a predetermined pressure or a predetermined flow rate. The pressure or the flow rate can be freely changed by a user inputting an instruction to the control unit 5. In other words, the control unit 5 can control the ejecting amount of the liquid 3 ejected from the liquid ejecting unit 1. Therefore, the liquid 3 can be automatically ejected from the liquid ejecting unit 1 in a preferable ejecting amount.

Hereinafter, preferable ejecting conditions for effectively improving the texture of the fabric will be described in detail. In the following evaluation, the liquid 3 was ejected from the liquid ejecting unit 1 onto the fabric F having a vertical length of 50 mm and a horizontal length of 25 mm using the fabric processing device 100A according to the embodiment, and thereafter, one end portion of the fabric F in a longitudinal direction was set in a horizontal state with a resin plate interposed therebetween by 5 mm, and the change in texture of the fabric F was evaluated based on a degree of mm of a dripping length d at a position 30 mm away from the resin plate in a horizontal direction at that time. The larger the dripping length d, the larger the change in texture, that is, GOOD. Results are shown in the following Table 1.

TABLE 1

| Ejecting speed (m/s) | d (mm) | Evaluation result |
|---|---|---|
| Without ejection | 6 | — |
| 20 | 7 | N.G. |
| 30 | 10 | GOOD |
| 44 | 12 | GOOD |

As shown in Table 1, in the fabric F onto which the liquid 3 was ejected at an ejecting speed of 20 m/s, for the fabric F in an initial state in which the liquid 3 was not ejected, there was no significant difference in the dripping length d, and there was little change in the texture of the fabric F. On the other hand, in the fabric F onto which the liquid 3 was ejected at ejecting speeds of 30 m/s and 44 m/s, the dripping length d was clearly longer than that of the fabric F in the initial state, and the change in the texture was remarkable.

As described above, in the fabric processing device 100A according to the embodiment, the liquid 3 ejected as the continuous flow 3*a* collides with the fabric F in the state of being the liquid droplets 3*b*, and it is preferable that the ejecting speed when ejecting the liquid 3 is 30 m/s or more in order to change the texture of the fabric F. That is, it is preferable that the fabric is processed by a method capable of applying, to the fabric F, a strong impact by which the liquid 3 ejected as the continuous flow 3*a* collides with the fabric F in the state of being the liquid droplets 3*b* at the high ejecting speed of 30 m/s or more in order to change the texture of the fabric F. This is because when the ejecting speed is less than 30 m/s, it may be difficult to apply a strong impact to the fabric F to change the texture of the fabric F, that is, N.G.

Here, the diameter of the ejecting port 4*a* in the liquid ejecting unit 1 of the fabric processing device 100A according to the embodiment is 0.12 mm. The following Table 2 shows a correspondence among an ejecting speed, a pressurizing pressure of the pressurizing unit 6, a liquid droplet forming distance which is the distance from the ejecting port 4*a* until the continuous flow 3*a* becomes the liquid droplets 3*b*, and an evaluation result of the change in the texture, when the liquid ejecting unit 1 according to the embodiment in which the diameter of the ejecting port 4*a* is 0.12 mm is used.

TABLE 2

| Ejecting speed (m/s) | Pressurizing pressure (MPa) | Liquid droplet forming distance (mm) | Evaluation result |
|---|---|---|---|
| 20 | 0.3 | 27 | N.G. |
| 30 | 0.5 | 40 | GOOD |
| 44 | 1.0 | 73 | GOOD |
| 50 | 1.5 | 90 | GOOD |

As described above, by setting the ejecting speed to 30 m/s or more, the texture of the fabric F can be changed. On the other hand, when the pressurizing pressure of the pressurizing unit 6 is larger than 1.5 MPa, for example, when an image and the like is recorded on the fabric F with ink, an image forming surface may be roughened. When the diameter of the ejecting port 4*a* is 0.12 mm and the pressurizing pressure of the pressurizing unit 6 is 1.5 MPa, the ejecting speed is 50 m/s as shown in Table 2.

The ejecting speed required for changing the texture of the fabric F depends on the diameter of the ejecting port 4*a*. The smaller the diameter of the ejecting port 4*a*, the faster the ejecting speed required for changing the texture of the fabric F. For example, when the ejecting port 4*a* having a diameter of 0.025 mm is used, the pressurizing pressure is 17 MPa and the ejecting speed is 180 m/s, and when the ejecting port 4*a* having a diameter of 0.005 mm is used, the pressurizing pressure is 150 MPa and the ejecting speed is 500 m/s. The following Table 3 shows a relationship between the diameter of the ejecting port 4*a*, the pressurizing pressure, the ejecting speed, and the flow rate of the liquid 3.

TABLE 3

| Diameter of ejecting port (mm) | Pressurizing pressure (MPa) | Ejecting speed (m/s) | Flow rate (mL/min) |
|---|---|---|---|
| 0.12 | 1.5 | 50 | 25 |
| 0.025 | 17 | 180 | 4.5 |
| 0.005 | 150 | 500 | 0.6 |

From the above, it is preferable that the liquid ejecting unit 1 ejects the liquid 3 as a continuous flow having the ejecting speed of 500 m/s or less. When the ejecting speed exceeds 500 m/s, the fabric may be damaged, and when the ejecting speed is set to 500 m/s or less, the ejecting condition is adjusted, and the texture of the fabric F can be effectively improved without damaging the fabric F. The damage of the fabric F includes damage of the fabric F itself and damage of a printed image and the like formed on the fabric F.

The ejecting port 4*a* preferably has a diameter of 0.005 mm or more and 0.12 mm or less. This is because, by setting the diameter of the ejecting port 4*a* as described above, it is possible to suitably eject the liquid 3 as a continuous flow and cause the liquid 3 to collide with the fabric F in the state of being the liquid droplets 3*b*.

The pressurizing pressure of the pressurizing unit 6 is preferably 0.5 MPa or more and 150 MPa or less. By setting the pressurizing pressure of the pressurizing unit 6 to 0.5 MPa or more and 150 MPa or less, the texture of the fabric F can be effectively improved without damaging the fabric F.

Second Embodiment

Figure 4:
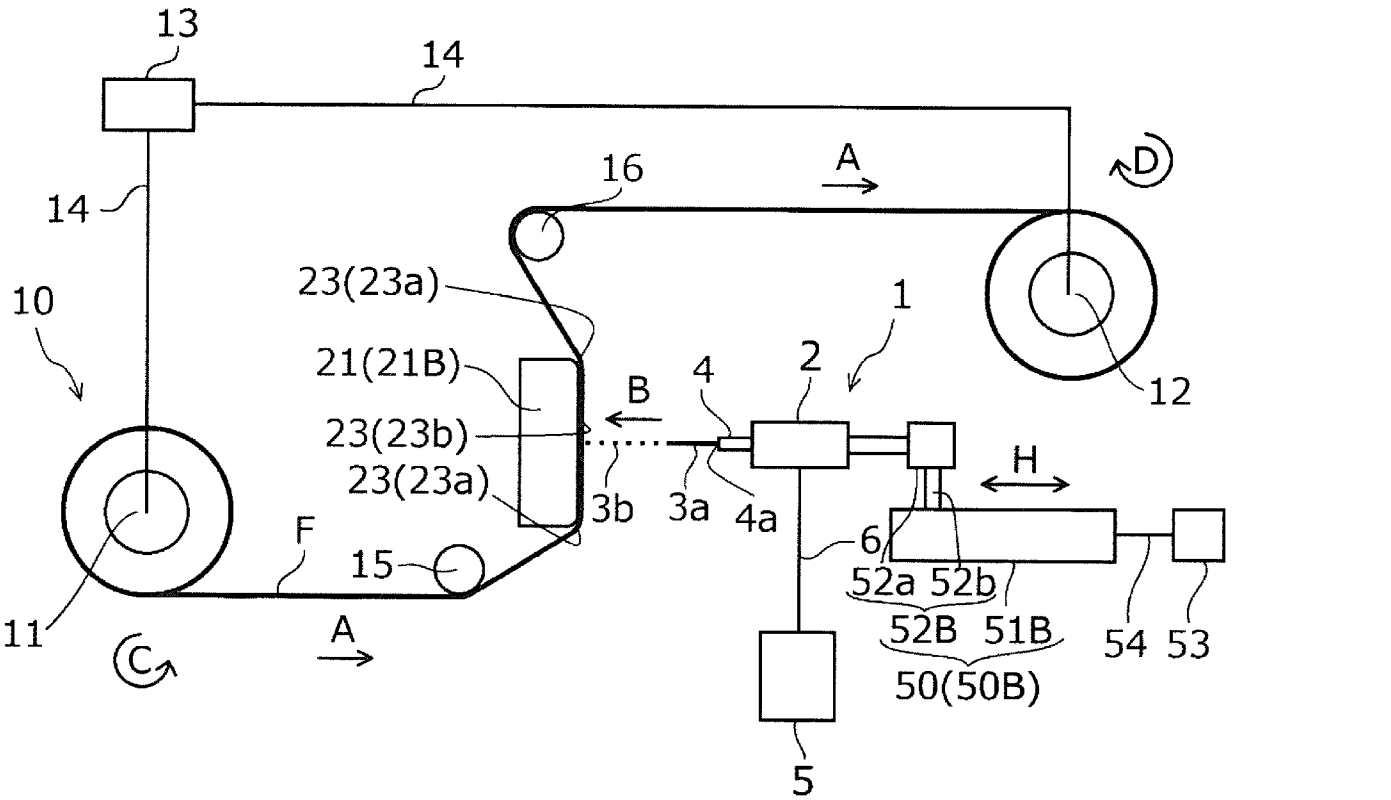
FIG. 4 is a schematic diagram showing a fabric processing device according to a second embodiment.

Hereinafter, a fabric processing device 100B according to a second embodiment as the fabric processing device 100 will be described with reference to FIG. 4. FIG. 4 is a diagram corresponding to FIG. 1 of the fabric processing device 100A according to the first embodiment. The fabric processing device 100B according to the embodiment is the same as the fabric processing device 100A according to the first embodiment except for the configuration described below. Therefore, the fabric processing device 100B according to the embodiment has the same features as those of the fabric processing device 100A according to the first embodiment except for the following description. Therefore, in FIG. 4, components common to those of the first embodiment are denoted by the same reference numerals, and detailed description thereof will be omitted.

As described above, in the fabric processing device 100A according to the first embodiment, the support surface 23 is formed only by the convex curved surface that protrudes toward the liquid ejecting unit 1 side as the support unit 21 that supports the fabric F. On the other hand, as shown in FIG. 4, a support unit 21B of the fabric processing device 100B according to the embodiment is provided between a driven roller 15 and a driven roller 16, and has convex curved surface portions 23*a* that protrude toward the liquid ejecting unit 1 side and a flat surface portion 23*b* as the support surface 23. The winding shaft 12 according to the embodiment rotates in a rotation direction D as the fabric F is transported.

In other words, the support surface 23 of the support unit 21B of the fabric processing device 100B according to the embodiment is a flat surface having the flat surface portion 23*b*. With such a configuration in which the support surface 23 is a flat surface, a wide range of the fabric F can be supported by the support surface 23, and the liquid 3 can be suitably ejected over the wide range of the fabric F. "The support surface 23 is a flat surface" means that, in detail, "a contact point between the support surface 23 and a straight line of the support surface 23 extending from the liquid ejecting unit 1 in the ejecting direction B and a peripheral region thereof are a flat surface". Therefore, as in the embodiment, the flat surface portion 23*b* may have the curved surface portions 23*a* and the like at both end portions of the flat surface portion 23*b*. By providing the curved surface portions 23*a* at both end portions of the flat surface portion 23*b*, it is possible to prevent the fabric F from being damaged by being rubbed against corner portions and the like of the support surface 23. In the embodiment, the ejecting direction B is the horizontal direction, and the ejecting direction B may not be the horizontal direction.

In the fabric processing device 100B according to the embodiment, the support unit 21B is disposed such that the flat surface portion 23*b* is substantially perpendicular to the ejecting direction B. However, the fabric processing device 100B is not limited to such a configuration, and for example, a support unit 21C having the same shape as the support unit 21B according to the embodiment may be provided in an arrangement in which an angle with respect to the ejecting direction B of the flat surface portion 23*b* is 45°. As described above, it is preferable that a normal line of a flat surface corresponding to the flat surface portion 23*b* of the support surface 23 forms an angle of 0° or more and 45° or less with respect to the horizontal plane. With such a configuration, it is possible to prevent the liquid 3 ejected from the liquid ejecting unit 1 from dripping onto the liquid ejecting unit 1, and it is also possible to prevent the liquid 3 rebounding from the support surface 23 from adhering to the liquid ejecting unit 1, and thus it is possible to prevent the occurrence of ejecting failure in the liquid ejecting unit 1.

Here, the adjusting unit 50B of the fabric processing device 100B according to the embodiment includes the interval control unit 53, a fixed unit 51B coupled to the interval control unit 53 via the cable 54, and a movable unit 52B. The movable unit 52B according to the embodiment includes a first coupling portion 52*a* coupled to the holding unit 2, and a second coupling portion 52*b* coupled to the first coupling portion 52*a* and movable in a moving direction H along the ejecting direction B with respect to the fixed unit 51B. The movable unit 52B is movable with respect to the fixed unit 51B in the moving direction H under the control of the interval control unit 53. The moving direction H in the embodiment corresponds to an interval direction between the liquid ejecting unit 1 and the fabric F.

Third Embodiment

Figure 5:
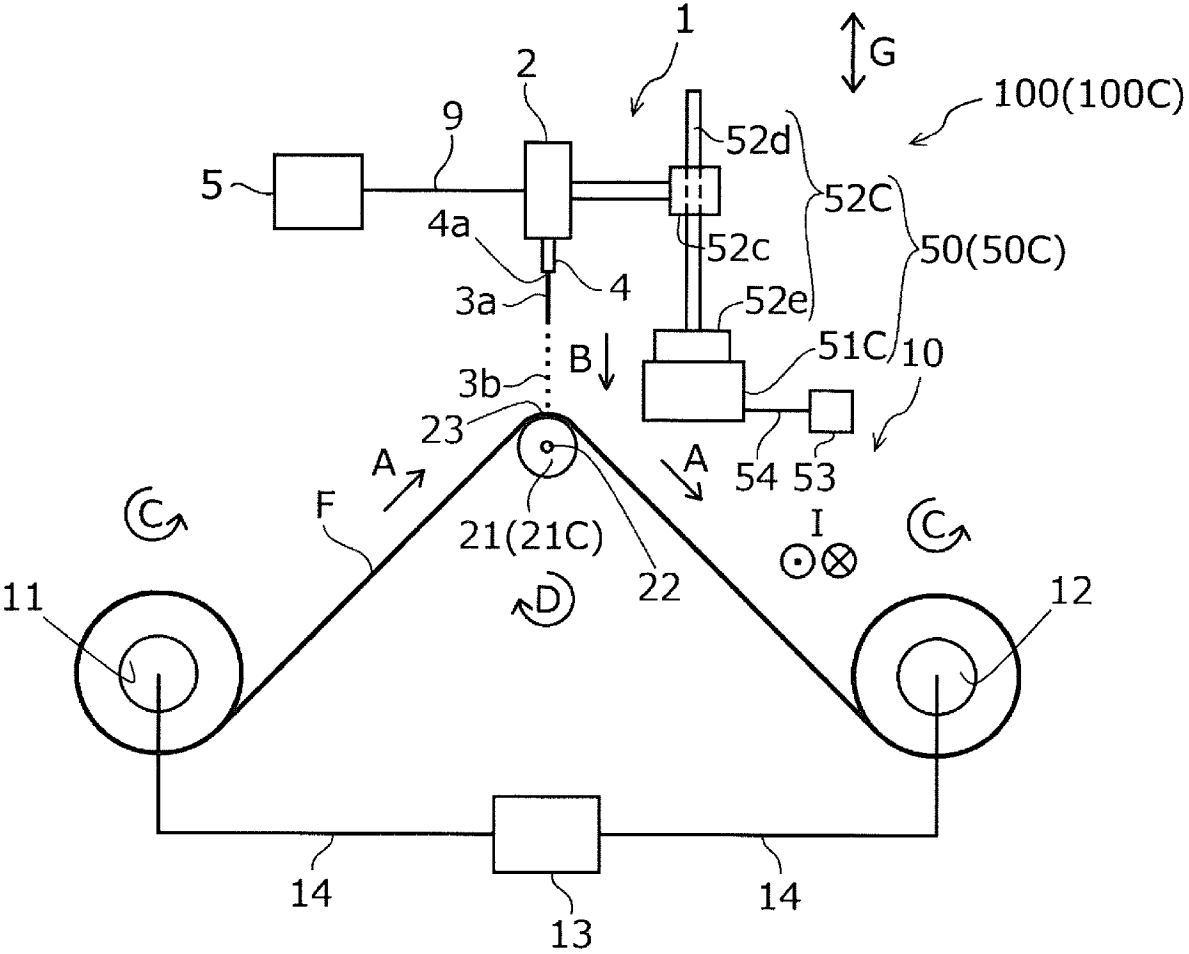
FIG. 5 is a schematic diagram showing a fabric processing device according to a third embodiment.
Figure 6:
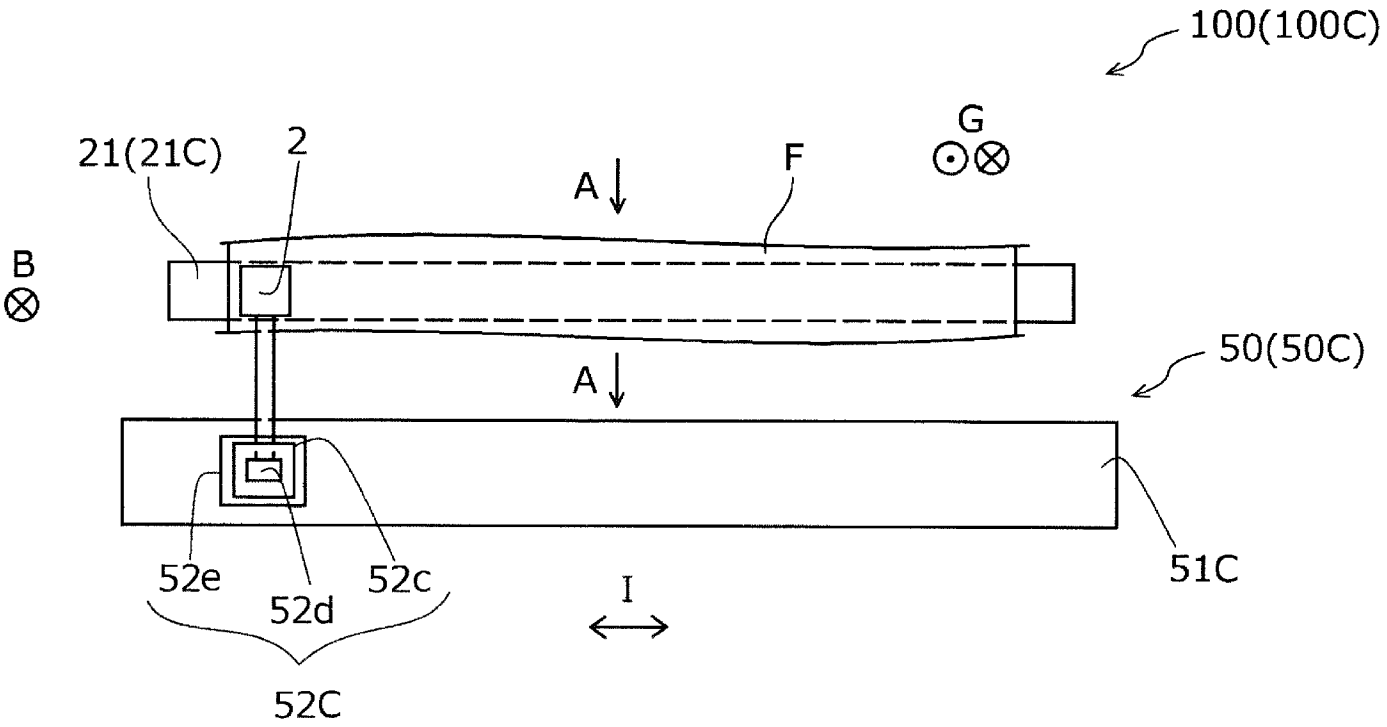
FIG. 6 is a schematic plan view showing a part of the fabric processing device in FIG. 5.

Hereinafter, a fabric processing device 100C according to a third embodiment as the fabric processing device 100 will be described with reference to FIGS. 5 and 6. Among them, FIG. 5 is a diagram corresponding to FIG. 1 of the fabric processing device 100A according to the first embodiment. The fabric processing device 100C according to the embodiment is the same as the fabric processing devices 100 according to the first embodiment and the second embodiment except for the configuration described below. Therefore, the fabric processing device 100C according to the embodiment has the same features as those of the fabric processing devices 100 according to the first embodiment and the second embodiment except for the following description. Therefore, in FIGS. 5 and 6, components common to those of the first embodiment and the second embodiment are denoted by the same reference numerals, and detailed description thereof will be omitted.

As described above, the fabric processing device 100A according to the first embodiment includes the support unit 21A, as the support unit 21 that supports the fabric F, in which only the support surface 23 is a convex curved surface protruding toward the liquid ejecting unit 1 side. The support unit 21A is immobile. On the other hand, the support unit 21C according to the embodiment has a columnar shape as shown in FIGS. 5 and 6, and is rotatable in the rotation direction D by following the transport of the fabric F with reference to a rotation shaft 22 shown in FIG. 6 in the same direction as the rotation shafts of the setting shaft 11 and the winding shaft 12. As described above, by forming the support unit 21 as a columnar rotation body, it is possible to reduce friction with the fabric F as compared with the support unit 21 having an immobile configuration, and thus it is possible to prevent the damage of the fabric F due to the friction.

As described above, the nozzles 4 of the fabric processing devices 100 according to the first embodiment and the second embodiment are line heads in which the plurality of ejecting ports 4*a* are provided in a line shape over the entire width direction. On the other hand, as shown in FIG. 6, the nozzle 4 according to the embodiment is a so-called serial type head capable of reciprocating in a reciprocating direction I intersecting the transport direction A via the holding unit 2. An adjusting unit 50C according to the embodiment includes a fixed unit 51C coupled to the interval control unit 53 via the cable 54, and a movable unit 52C. The movable unit 52C includes a third coupling portion 52*c* coupled to the holding unit 2, a shaft portion 52*d* extending in the interval direction G, and a fourth coupling portion 52*e* movably attached to the fixed unit 51C in the reciprocating direction I. The entire movable unit 52C is movable with respect to the fixed unit 51C in the reciprocating direction I under the control of the control unit 5, and the third coupling portion 52*c* moves in the interval direction G with respect to the fourth coupling portion 52*e* along the shaft portion 52*d* under the control of the interval control unit 53, and thus an interval between the liquid ejecting unit 1 and the fabric F can be adjusted.

As described above, in the fabric processing device 100C according to the embodiment, the holding unit 2 can be reciprocated in the reciprocating direction I intersecting the transport direction A, and the adjusting unit 50C according to the embodiment also serves as a moving mechanism for reciprocating the holding unit 2 in the reciprocating direction I. As in the fabric processing device 100C according to the embodiment, by adopting a configuration including the moving mechanism that reciprocates the holding unit 2 in a direction intersecting the transport direction A, it is possible to eject the liquid 3 over the entire width direction of the fabric F using the small liquid ejecting unit 1 and the holding unit 2.

Fourth Embodiment

Figure 7:
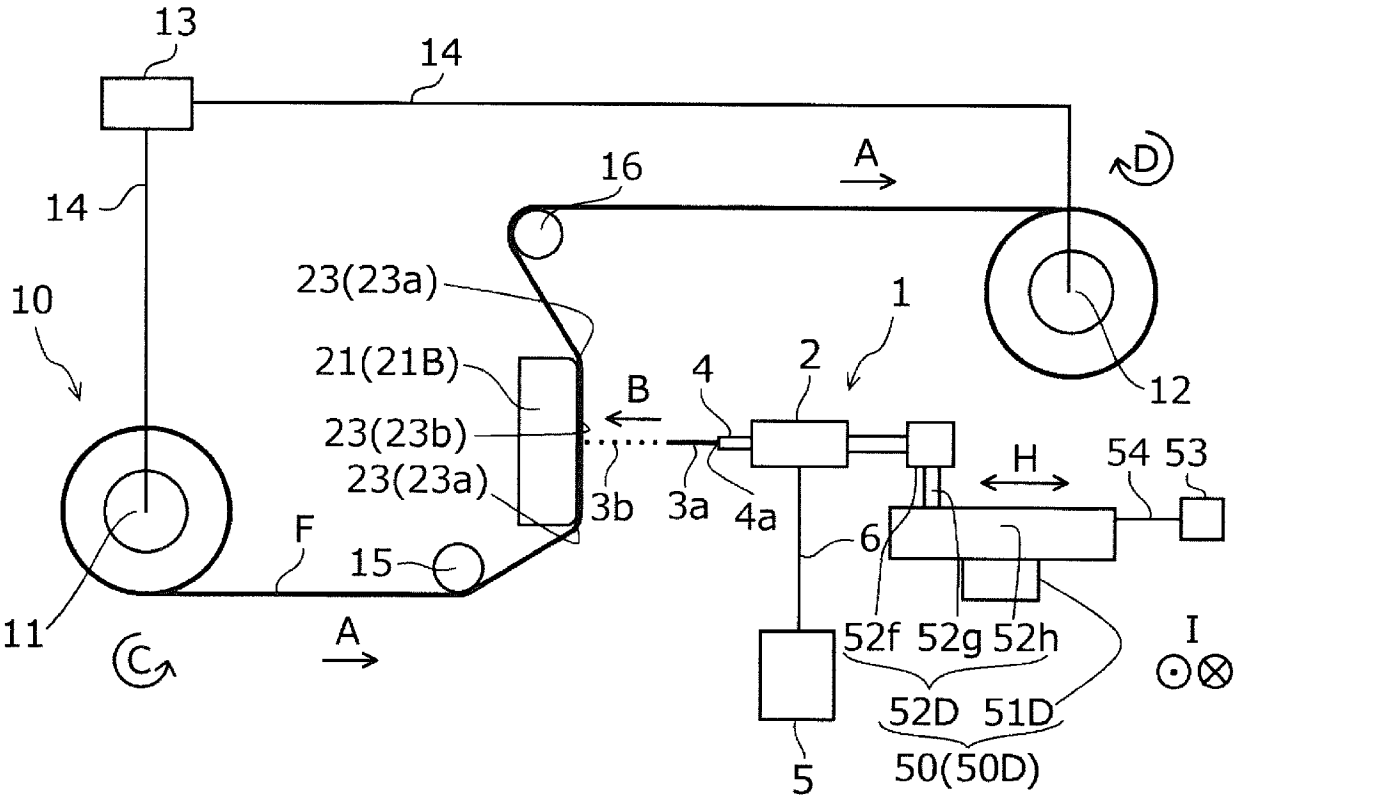
FIG. 7 is a schematic diagram showing a fabric processing device according to a fourth embodiment.
Figure 8:
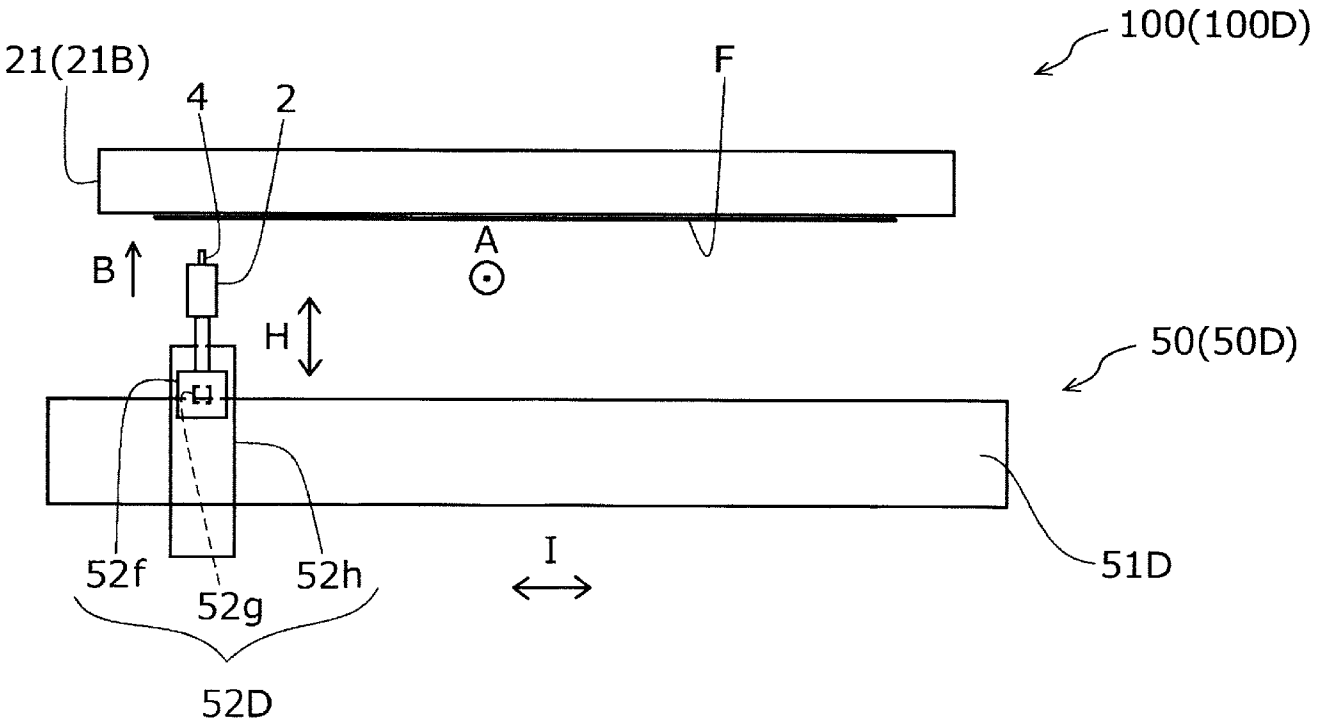
FIG. 8 is a schematic plan view showing a part of the fabric processing device in FIG. 7.

Hereinafter, a fabric processing device 100D according to a fourth embodiment as the fabric processing device 100 will be described with reference to FIGS. 7 and 8. Among them, FIG. 7 is a diagram corresponding to FIG. 5 of the fabric processing device 100C according to the third embodiment. FIG. 8 is a diagram corresponding to FIG. 6 of the fabric processing device 100C according to the third embodiment. The fabric processing device 100D according to the embodiment is the same as the fabric processing devices 100 according to the first embodiment to the third embodiment except for the configuration described below. Therefore, the fabric processing device 100D according to the embodiment has the same features as those of the fabric processing devices 100 according to the first embodiment to the third embodiment except for the following description. Therefore, in FIGS. 7 and 8, components common to those of the first embodiment to the third embodiment are denoted by the same reference numerals, and detailed description thereof will be omitted.

As shown in FIG. 7, the fabric processing device 100D according to the embodiment has the same configuration as the fabric processing device 100B according to the second embodiment except for the configuration of the liquid ejecting unit 1 and the adjusting unit 50. More specifically, as shown in FIG. 8, the nozzle 4 of the liquid ejecting unit 1 according to the embodiment is a so-called serial type head capable of reciprocating in the reciprocating direction I intersecting the transport direction A via the holding unit 2, similarly to the nozzle 4 of the fabric processing device 100C according to the third embodiment. An adjusting unit 50D according to the embodiment includes a fixed unit 51D coupled to the interval control unit 53 via the cable 54, and a movable unit 52D. The movable unit 52D includes a fifth coupling portion 52*f* coupled to the holding unit 2, a sixth coupling portion 52*g* coupled to the fifth coupling portion 52*f*, and a seventh coupling portion 52*h* that is coupled to the sixth coupling portion 52*g* and is movably attached to the fixed unit 51D in the moving direction H. The entire movable unit 52D is movable with respect to the fixed unit 51D in the reciprocating direction I under the control of the control unit 5, and the sixth coupling portion 52*g* moves with respect to the seventh coupling portion 52*h* along the moving direction H under the control of the interval control unit 53, and thus the interval between the liquid ejecting unit 1 and the fabric F can be adjusted.

Fifth Embodiment

Figure 9:
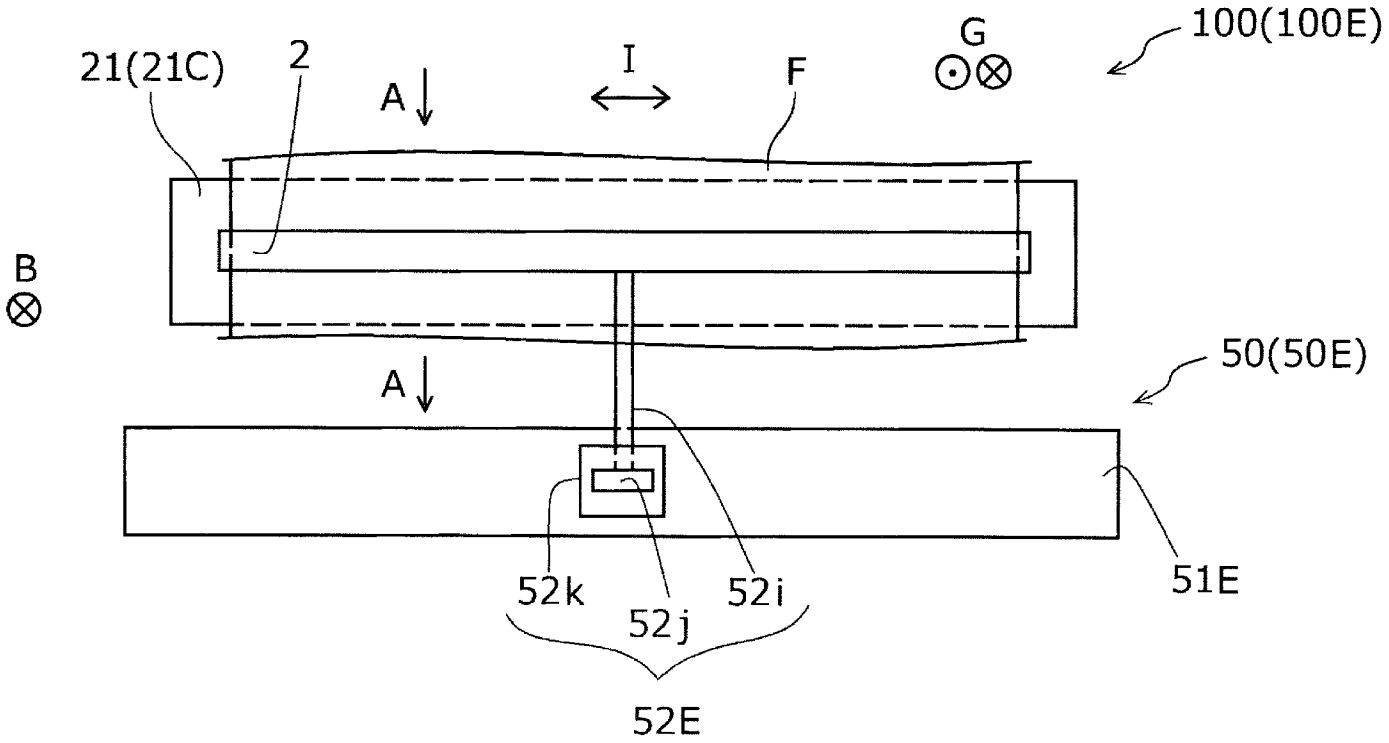
FIG. 9 is a schematic plan view showing a part of a fabric processing device according to a fifth embodiment.

Hereinafter, a fabric processing device 100E according to a fifth embodiment as the fabric processing device 100 will be described with reference to FIGS. 9 and Among them, FIG. 9 is a diagram corresponding to FIG. 6 of the fabric processing device 100C according to the third embodiment. The fabric processing device 100E according to the embodiment is the same as the fabric processing devices 100 according to the first embodiment to the fourth embodiment except for the configuration described below. Therefore, the fabric processing device 100E according to the embodiment has the same features as those of the fabric processing devices 100 according to the first embodiment to the fourth embodiment except for the following description. Therefore, in FIGS. 9 and 10, components common to those of the first embodiment to the fourth embodiment are denoted by the same reference numerals, and detailed description thereof will be omitted.

As shown in FIG. 9, in the fabric processing device 100E according to the embodiment, the nozzle 4 is a line head in which the plurality of ejecting ports 4*a* are provided in a line shape over the entire width direction, similarly to the fabric processing devices 100 according to the first embodiment and the second embodiment. The fabric processing device 100E according to the embodiment is substantially the same as the fabric processing device 100C according to the third embodiment shown in FIG. 5 in a side view.

Although not shown in FIG. 9, an adjusting unit 50E according to the embodiment includes a fixed unit 51E coupled to the interval control unit 53 via the cable 54, and a movable unit 52E. The movable unit 52E includes an eighth coupling portion 52*i* coupled to the holding unit 2, a shaft portion 52*j* extending in the interval direction G, and a ninth coupling portion 52*k* that is coupled to the shaft portion 52*j* and is movably attached to the fixed unit 51E in the reciprocating direction I.

Figure 10:
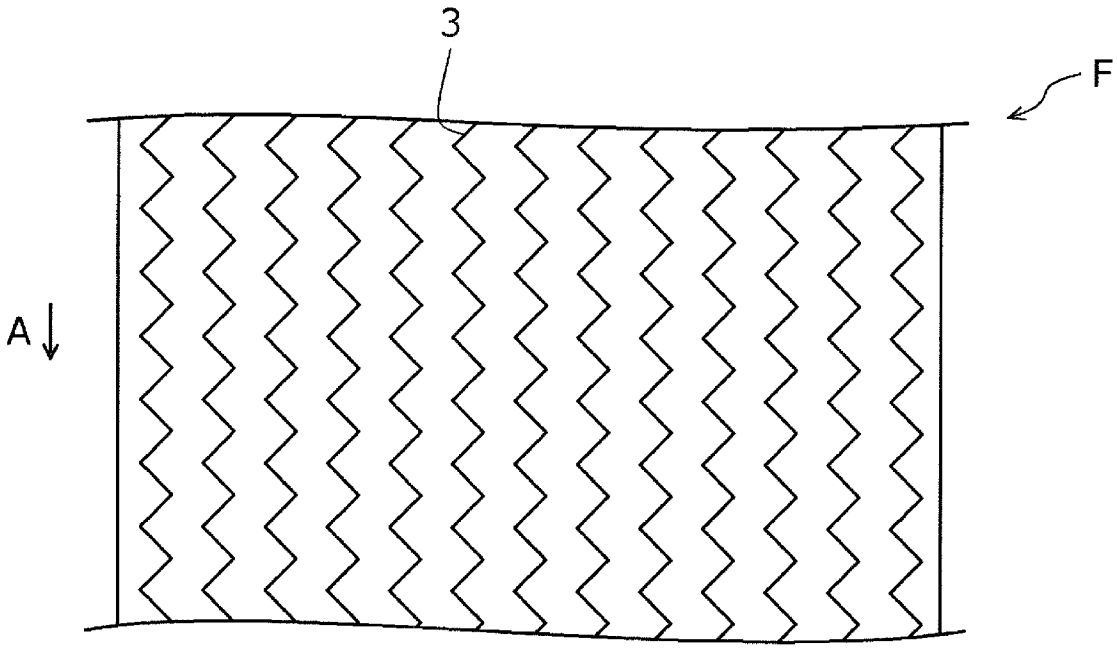
FIG. 10 is a schematic diagram showing a state in which a liquid is ejected onto a fabric using the fabric processing device in FIG. 9.

That is, in the liquid ejecting unit 1 of the fabric processing device 100E according to the embodiment, the plurality of ejecting ports 4*a* are provided over the entire reciprocating direction I corresponding to the width direction intersecting the transport direction A of the fabric F. The liquid ejecting unit 1 is movable so as to slightly vibrate in the reciprocating direction I during the transport of the fabric F. Here, FIG. 10 shows a state when the liquid 3 is ejected onto the fabric F using the fabric processing device 100E according to the embodiment. As described above, the fabric processing device 100E according to the embodiment can eject the liquid 3 particularly densely onto the fabric F.

Sixth Embodiment

Figure 11:
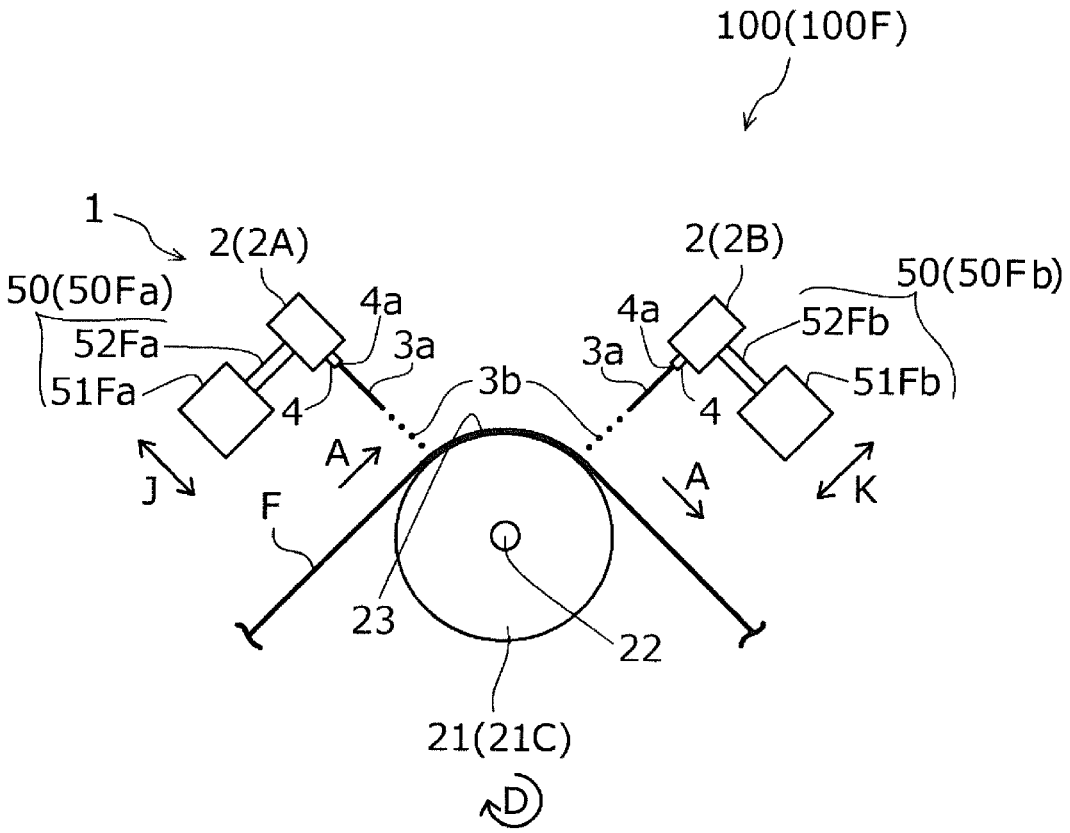
FIG. 11 is a schematic diagram showing a part of a fabric processing device according to a sixth embodiment.
Figure 12:
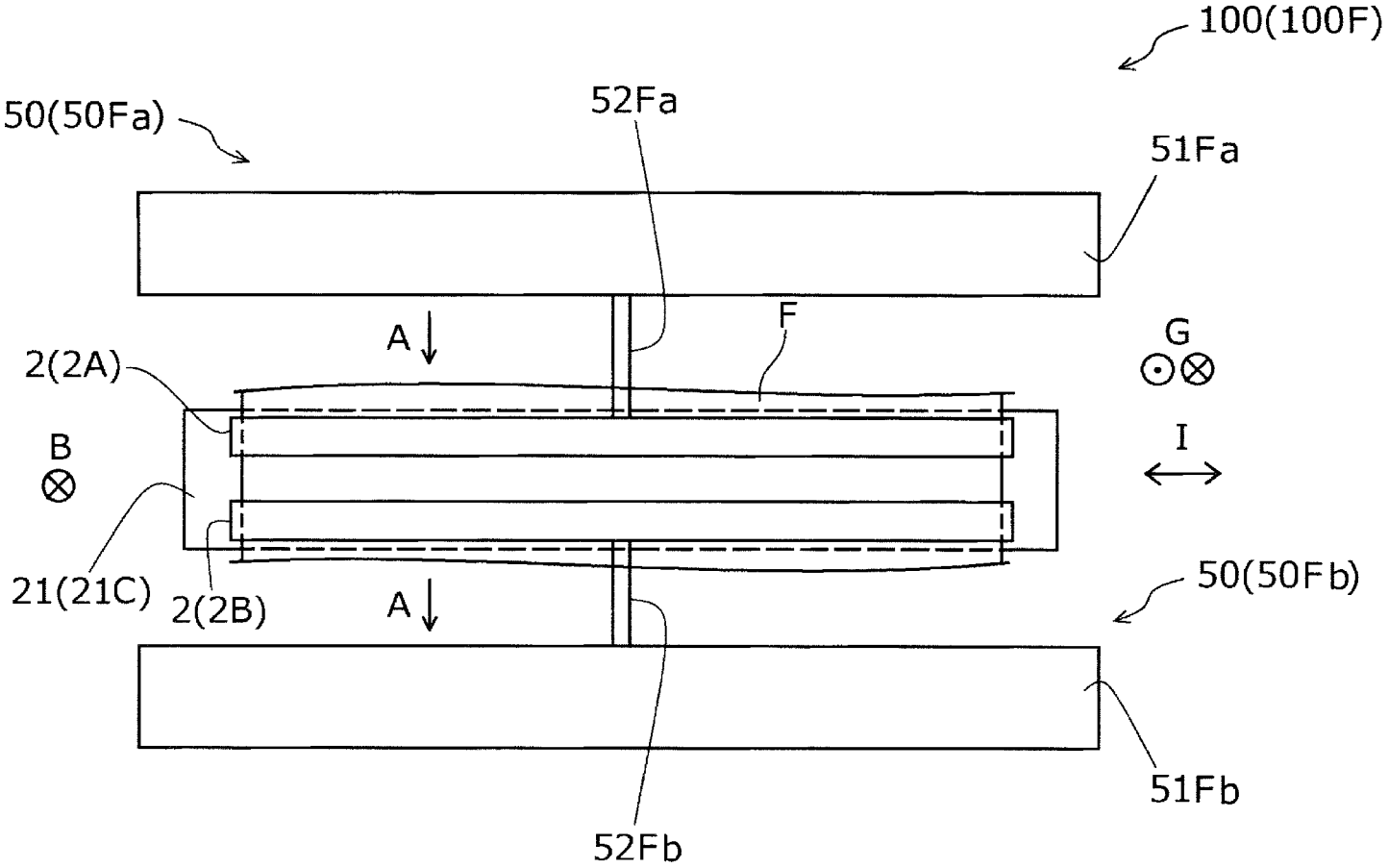
FIG. 12 is a schematic plan view showing a part of the fabric processing device in FIG. 11.
Figure 13:
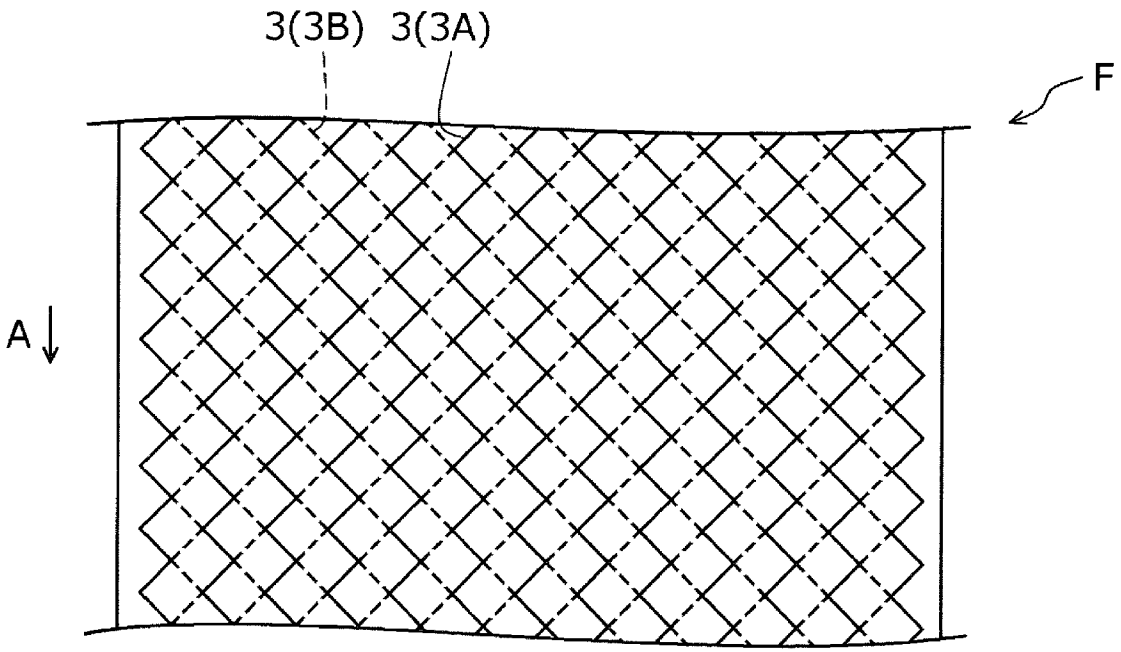
FIG. 13 is a schematic diagram showing a state in which a liquid is ejected onto a fabric using the fabric processing device in FIG. 11.

Hereinafter, a fabric processing device 100F according to a sixth embodiment as the fabric processing device 100 will be described with reference to FIGS. 11 to 13. Among them, FIG. 12 is a diagram corresponding to FIG. 9 of the fabric processing device 100E according to the fifth embodiment. FIG. 13 is a diagram corresponding to FIG. 10 of the fabric processing device 100E according to the fifth embodiment. The fabric processing device 100F according to the embodiment is the same as the fabric processing devices 100 according to the first embodiment to the fifth embodiment except for the configuration described below. Therefore, the fabric processing device 100F according to the embodiment has the same features as those of the fabric processing devices 100 according to the first embodiment to the fifth embodiment except for the following description. Therefore, in FIGS. 11 to 13, components common to those of the first embodiment to the fifth embodiment are denoted by the same reference numerals, and detailed description thereof will be omitted.

As described above, the liquid ejecting unit 1 of the fabric processing device 100 according to each of the first embodiment to the fifth embodiment includes only one holding unit 2 provided with the nozzle 4. On the other hand, as shown in FIG. 11 and FIG. 12, the liquid ejecting unit 1 of the fabric processing device 100F according to the embodiment includes a plurality of the holding units 2 in which the nozzles 4 are provided, that is, a first holding unit 2A and a second holding unit 2B. Here, the first holding unit 2A and the second holding unit 2B according to the embodiment have the same configuration as the holding unit 2 of the fabric processing device 100E according to the fifth embodiment, and are movable in the reciprocating direction I. The first holding unit 2A can be moved in a moving direction J by an adjusting unit 50Fa including a fixed unit 51Fa and a movable unit 52Fa to adjust the interval between the liquid ejecting unit 1 and the fabric F. The second holding unit 2B can be moved in a moving direction K by an adjusting unit 50Fb including a fixed unit 51Fb and a movable unit 52Fb to adjust the interval between the liquid ejecting unit 1 and the fabric F.

By using the fabric processing device 100F according to the embodiment, as shown in FIG. 13, it is possible to eject the liquid 3 particularly densely onto the fabric F more than the case of using the fabric processing device 100E according to the fifth embodiment. A liquid 3A indicated by a solid line in FIG. 13 represents the liquid 3 ejected from the nozzle 4 of the first holding unit 2A. A liquid 3B indicated by a broken line in FIG. 13 represents the liquid 3 ejected from the nozzle 4 of the second holding unit 2B.

Seventh Embodiment

Figure 14:
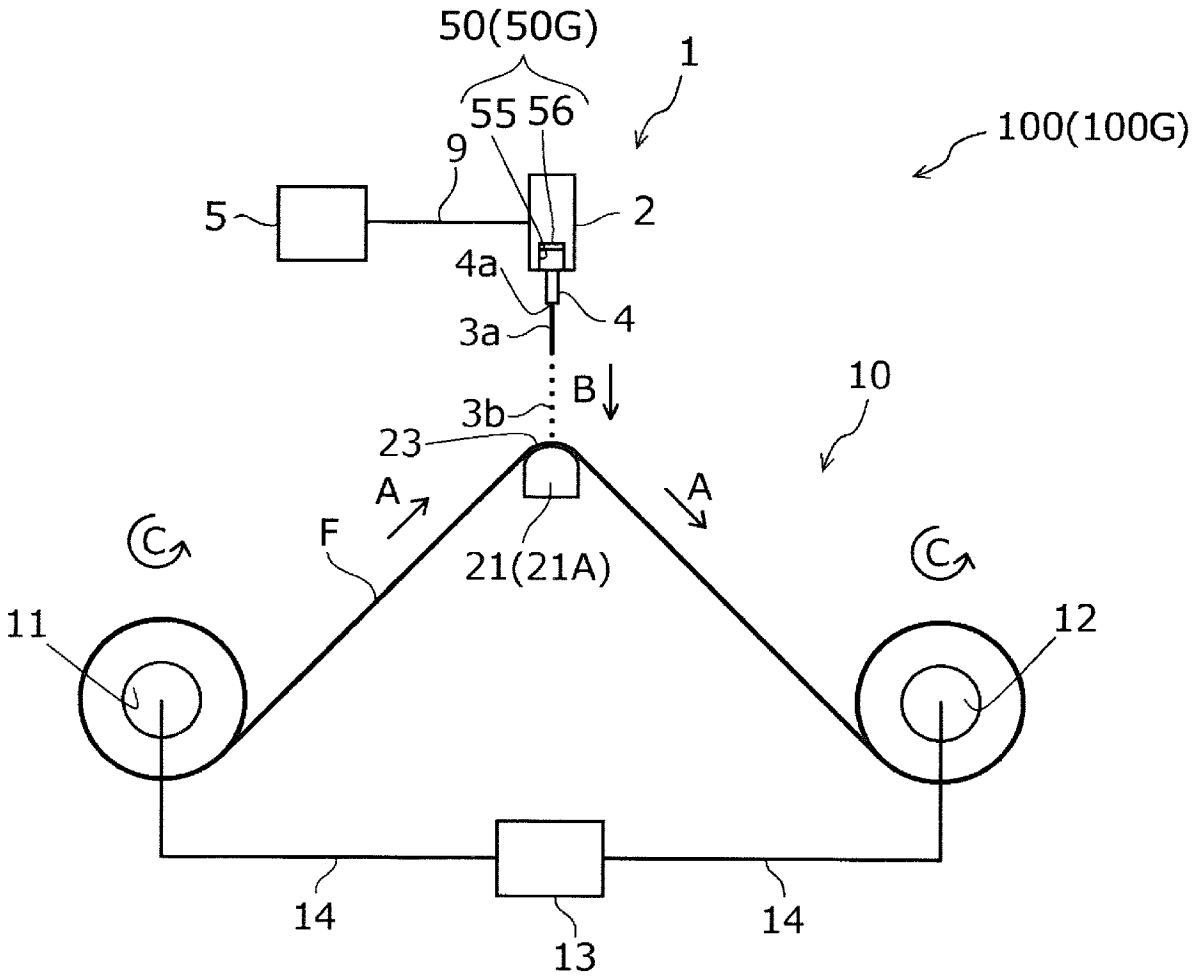
FIG. 14 is a schematic diagram showing a fabric processing device according to a seventh embodiment.

Hereinafter, a fabric processing device 100G according to a seventh embodiment as the fabric processing device 100 will be described with reference to FIG. 14. FIG. 14 is a diagram corresponding to FIG. 1 of the fabric processing device 100A according to the first embodiment. The fabric processing device 100G according to the embodiment is the same as the fabric processing devices 100 according to the first embodiment to the sixth embodiment except for the configuration described below. Therefore, the fabric processing device 100G according to the embodiment has the same features as those of the fabric processing devices 100 according to the first embodiment to the sixth embodiment except for the following description. Therefore, in FIG. 13, components common to those of the first embodiment to the sixth embodiment are denoted by the same reference numerals, and detailed description thereof will be omitted.

As described above, the adjusting unit 50 of the liquid ejecting unit 1 of the fabric processing device 100 according to each of the first embodiment to the fifth embodiment is an interval adjusting unit that adjusts the interval between the liquid ejecting unit 1 and the fabric F such that the liquid 3 collides with the fabric F in the state of being the liquid droplets 3*b*. On the other hand, the liquid ejecting unit 1 of the fabric processing device 100G according to the embodiment includes, as the adjusting unit 50, an adjusting unit 50G having a mechanism different from the interval adjusting unit. Specifically, the adjusting unit 50G according to the embodiment is a member which constitutes a head portion and the nozzle 4 while being held by the holding unit 2, and includes a liquid chamber 55 capable of housing the liquid 3, and a piezoelectric element 56 capable of applying vibration to the liquid 3 in the liquid chamber 55. In the embodiment, the piezoelectric element 56 made of $BaTiO_3$, PZT, $PbTiO_3$, and the like is used to apply vibration to the liquid 3 in the liquid chamber 55, and an electrostatic actuator in which an induction body is sandwiched between electrodes may be used instead of the piezoelectric element 56.

The adjusting unit 50G according to the embodiment can adjust the liquid droplet forming distance, which is a distance from the liquid ejecting unit 1 until the liquid 3 ejected as the continuous flow 3*a* becomes the liquid droplets 3*b*, by applying vibration having a desired frequency to the liquid 3 in the liquid chamber 55. That is, the adjusting unit 50G according to the embodiment is a liquid droplet forming distance adjusting unit that adjusts the liquid droplet forming distance such that the liquid 3 collides with the fabric F in the state of being the liquid droplets 3*b*. With such a configuration, it is possible to cause the liquid 3 ejected as the continuous flow 3*a* from the liquid ejecting unit 1 to collide with the fabric F in the state of being the liquid droplets 3*b* without changing the interval between the liquid ejecting unit 1 and the fabric F. Since there is no mechanism for changing the interval between the liquid ejecting unit 1 and the fabric F, the entire device can be downsized.

The present disclosure is not limited to the embodiments described above, and can be implemented in various configurations without departing from the scope of the disclosure. In order to solve a part or all of problems described above, or to achieve a part or all of effects described above, technical features in the embodiment corresponding to the technical features in each aspect described in the summary of the disclosure can be replaced or combined as appropriate. When the technical features are not described as essential in the present description, the technical features can be appropriately deleted.

What is claimed is:

1. A fabric processing device comprising:

a transport unit configured to transport a fabric in a transport direction;

a support unit configured to support the fabric;

a liquid ejecting unit configured to eject a liquid onto the fabric supported by the support unit;

an adjusting unit configured to adjust the liquid ejected as a continuous flow from the liquid ejecting unit to collide with the fabric in a state of being liquid droplets; and a holding unit configured to hold the liquid electing unit, wherein the adjusting unit is an interval adjusting unit configured to adjust an interval between the liquid electing unit and the fabric such that the liquid collides with the fabric in the state of being the liquid droplets, the interval adjusting unit is coupled to the holding unit, the interval adjusting unit includes a fixed unit and a movable unit whose position in an interval direction between the liquid ejecting unit and the fabric can be changed with respect to the fixed unit, and the holding unit is coupled to the movable unit.

2. The fabric processing device according to claim 1, further comprising:

a moving mechanism configured to reciprocate the holding unit in a direction intersecting the transport direction.

3. The fabric processing device according to claim 1, wherein the adjusting unit is a liquid droplet forming distance adjusting unit configured to adjust a liquid droplet forming distance, which is a distance from the liquid ejecting unit until the liquid ejected as the continuous flow becomes the liquid droplets, such that the liquid collides with the fabric in the state of being the liquid droplets.

4. The fabric processing device according to claim 1, wherein the liquid ejecting unit is configured to eject the liquid in the continuous flow at an ejecting speed of 30 m/s or more.

5. The fabric processing device according to claim 4, wherein the liquid ejecting unit is configured to eject the liquid in the continuous flow at an ejecting speed of 500 m/s or less.

6. The fabric processing device according to claim 1, wherein the support unit has a support surface that supports the fabric, and the liquid ejecting unit is disposed at a position facing the support surface.

7. The fabric processing device according to claim 6, wherein the support surface is a convex curved surface protruding toward a liquid ejecting unit side.

8. The fabric processing device according to claim 6, wherein the support surface is a flat surface.

9. The fabric processing device according to claim 8, wherein the support surface has a normal line of the flat surface forming an angle of 0° or more and 45° or less with respect to a horizontal plane.

10. The fabric processing device according to claim 1, wherein the liquid ejecting unit includes a nozzle having at least one ejecting port configured to eject the liquid, a liquid transport unit configured to transport the liquid to the ejecting port, and a pressurizing unit configured to pressurize the liquid in the liquid transport unit.

11. The fabric processing device according to claim 10, wherein a plurality of the ejecting ports are provided over the entire liquid ejecting unit in a direction intersecting the transport direction of the fabric, and the liquid ejecting unit is configured to be movable in the direction intersecting the transport direction during transport of the fabric.

12. The fabric processing device according to claim 1, further comprising:

a control unit configured to control an ejecting amount of the liquid ejected from the liquid ejecting unit.

13. The fabric processing device according to claim 1, wherein the transport unit includes a driving roller configured to transport the fabric in the transport direction by rotating.

* * * * *